US006039919A

United States Patent [19]

Nagashima et al.

[11] Patent Number: 6,039,919

[45] Date of Patent: Mar. 21, 2000

[54] HIGH CORROSION RESISTING ALLOY FOR DIESEL ENGINE VALVE

[75] Inventors: Tomotaka Nagashima, Tokai; Michio Okabe, Chita; Toshiharu Noda, Tajimi; Kiyoshi Okawachi, Tokyo, all of Japan

[73] Assignees: Daido Tokushuko Kabushiki Kaisha, Nagoya; Nittan Valve Co., Ltd., Tokyo, both of Japan

[21] Appl. No.: 09/017,877

[22] Filed: Feb. 3, 1998

[30] Foreign Application Priority Data

Feb. 7, 1997 [JP] Japan ..... 9-039937

[51] Int. Cl.[7] ..... C22C 19/05

[52] U.S. Cl. ..... 420/446; 420/449; 148/428

[58] Field of Search ..... 420/446, 449; 148/428

[56] References Cited

FOREIGN PATENT DOCUMENTS 273532 10/1964 Australia ..... 420/449

*Primary Examiner*—Deborah Yee

*Attorney, Agent, or Firm*—Sughrue, Mion, Zinn, Macpeak & Seas, PLLC

[57] ABSTRACT

A high corrosion resisting alloy for use in inlet and exhaust valves of diesel engines which is low in cost and excellent in corrosion resistance and strength, which consists by weight percentage of C≦0.1%, Si≦1.0%, Mn≦1.0%, 25%<Cr≦32%, 2.0%<Ti≦3.0%, 1.0%≦Al≦2.0% and the balance being Ni and incidental impurities. The valves for the diesel engines are manufactured through the steps of forging the above-mentioned alloy into near net shapes of the valves, performing aging treatment (after solid solution treatment according to demand), and further enhancing hardness of the valves at their valve faces locally through partial cold forging.

8 Claims, 1 Drawing Sheet

HIGH CORROSION RESISTING ALLOY FOR DIESEL ENGINE VALVE

BACKGROUND OF THE INVENTION

1. Field of the Invention

This invention relates to an alloy for a diesel engine valve which is excellent in the corrosion resistance and the strength, and a method for producing a diesel engine valve.

2. Description of the Prior Art

Heretofore, heat resisting steels such as JIS SUH 35(Fe-9Mn-21Cr-4Ni-0.5C-0.4N) or the like have been used as a material for inlet valves and exhaust valves of diesel engines, however Nimonic 80A (described later as conventional alloy No. 7 in Table 1) which is a Ni-based supper heat resisting alloy containing 20% of Cr and more excellent in the corrosion resistance is beginning to be employed considering power up of the generating power and temperature rise of combusion gas of the diesel engines in recent years.

However, aforementioned Nimonic 80A is sufficiently excellent in the strength, although there is a problem in that it is not sufficient in the corrosion resistance, especially in resistance against sulfure attack caused by sulfides formed on the surface of the valves according to sulfur contained in fuel.

As compared with the above, although Udimet 520 (described later as conventional alloy No. 8 in Table 1) which contains 12% of Co in addition to 20% of Cr has excellent corrosion resistance, there is a problem in the cost owing to addition of expensive Co in a large quantity.

Furthermore, Nimonic 81 (described later as conventional alloy No. 9 in Table 1) of which Cr content is increased into 30% has sufficient corrosion resistance because of the addition of Cr in a large quantity, but there is another problem in that it is insufficient in the strength as inlet and exhaust valves of the diesel engines.

SUMMARY OF THE INVENTION

The high corrosion resisting alloy for a diesel engine valve and the method for producing a diesel engine valve according to this invention have been developed in order to solve the aforementioned problems of the prior art.

Namely, the high corrosion resisting alloy according this invention is characterized by consisting by weight percentage of not more than 0.1% of C, not more than 1.0% of Si, not more than 1.0% of Mn, more than 25% and not more than 32% of Cr, more than 2.0% and not more than 3.0% of Ti, 1.0 to 2.0% of Al, and balance being Ni plus incidental impulities.

The high corrosion resisting alloy according to a preferred embodiment of this invention is characterized in that Fe and Co as the impulities are controlled to not more than 3.0% and 2.0%, respectively.

The high corrosion resisting alloy according to another preferred embodiment of this invention is characterized in that the alloy further contains one or both of not more than 0.02% of B and not more than 0.15% of Zr.

The method for producing valves for a diesel engine valve according to another aspect of this invention is characterized by comprising the steps of forging a raw material of the high corrosion resisting alloy according to this invention into a valve shape of the diesel engine, subjecting the obtained valve shaped forging to aging treatment after or without solid solution treatment, and partially enhancing hardness of the valve by subjecting the aging treated forging to partial cold wording. The solid solution treatment may be omitted in a case of increasing the strength in a portion excepting the cold-worked part.

BRIEF DESCRIPTION OF THE DRAWINGS

A single FIGURE is a schematic illustration showing a shape and a partial cold-worked portion of a diesel engine valve produced in an example of this invention.

DETAILED DESCRIPTION OF THE INVENTION

Figure 1:
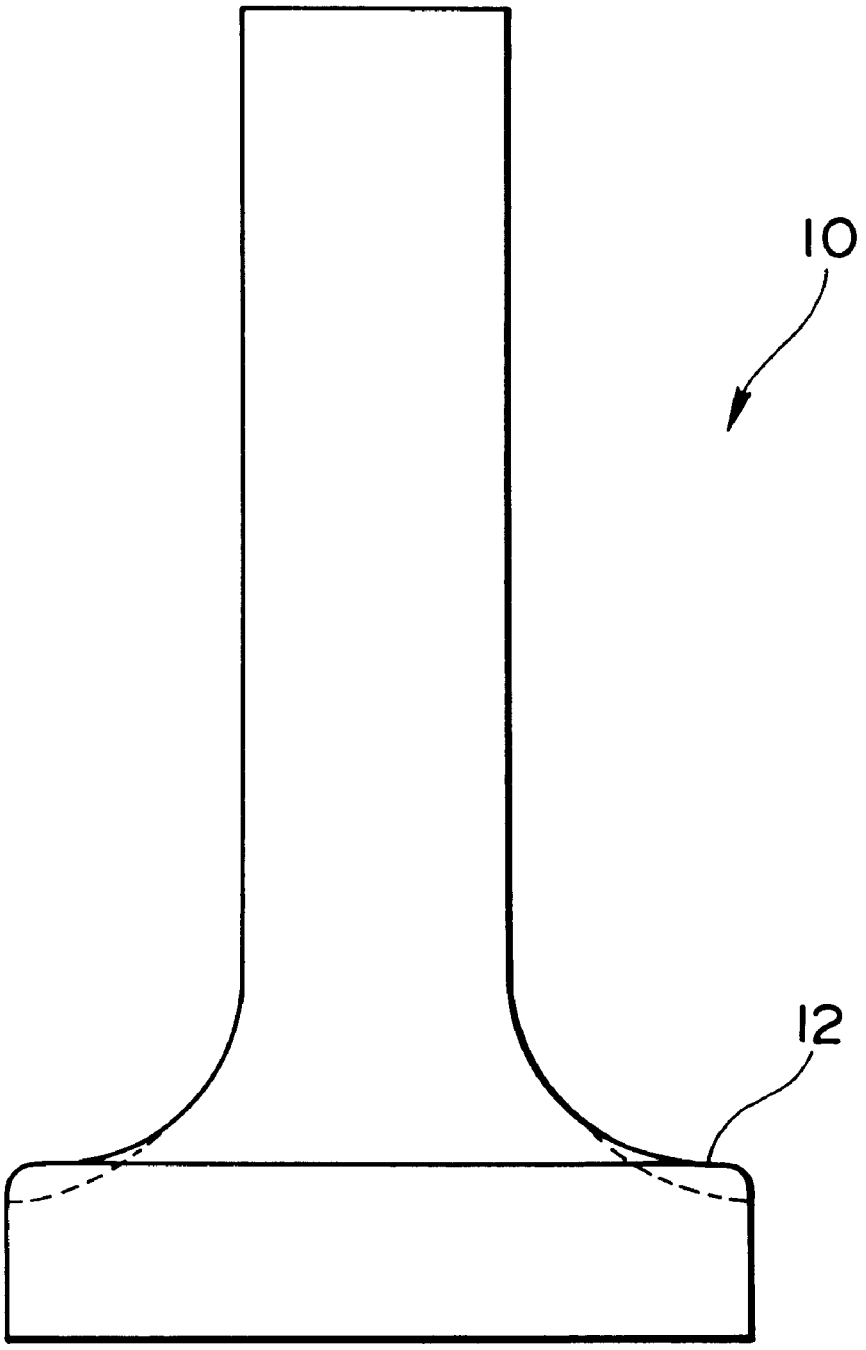

In the high corrosion resisting alloy for the diesel engine valve according to this invention, Cr more than 25% and not more than 32% is added in a large quantity in a Ni-based alloy similarly to Nimonic 81, at the same time Ti and Al are contained abundantly ($2\%<Ti\leqq3.0\%$, $1.0\%\leqq Al\leqq2.0\%$) and balance of these elements is optimized against the other elements such as C, Si, Mn and so on. The Ni-based alloy according to this invention has satisfactory corrosion resistance on account of addition of Cr and has high strength according to increase of Ti and Al, so that it is possible to be used suitably as an inlet valve and an exhaust valve of the diesel engine.

The high corrosion resisting alloy according to this invention is the alloy of which corrosion resistance is improved without positive addition of expensive Co, and it is possible to reduce the cost of the alloy.

In the alloy according to this invention, Fe content and Co content may be controlled to not more than 3.0% of Fe and not more than 2.0% of Co, respectively.

The Fe content means the amount contained as impurities, it is possible to ensure the large amount of Ni by controlling Fe so as not exceed a certain value.

Further, by controlling Co to not higher than 2.0%, in other words by permitting the amount of Co up to 2.0%, it becomes unnecessary to severely select raw materials in order to inhibit admixture of Co and it is possible to control an increase in cost caused by raising the standards for selection of materials.

In the high corrosion resisting alloy according to this invention, one or both of B and Zr may be contained as grain boundary reinforcing elements in the predetermined range. It is possible to improve creep strength of the alloy effectively by addition of these elements.

In the method for producing the diesel engine valve according to another aspect of this invention, the material alloy having the aforementioned chemical compositions is forged into the valve shape, and aging treatment is carried out after solid solution treatment or directly without the solid solution treatment. Subsequently, partial cold working is performed to, for example, a valve face or so, whereby hardness of the valve is partially enhanced. According to such the method, it is possible to reinforce the valve effectively only on the portion especially required for the strength. Furthermore, the solid solution treatment may be omitted according to required properties as mentioned above.

The reason why the chemical compositions of the alloy according to this invention are limited will be described below in detail.

C: not more than 0.1%

C combines with Ti or Cr to form carbides and improves the high-temperature strength of the alloy, however ductility of the alloy is lowered when C is contained in the alloy more than 0.1%, therefore the upper limit of C is defined as 0.1%.

Si: not more than 1.0%

Si contributes to increasing hardness of the alloy, but the ductility of the alloy is lowered if Si is contained in the alloy more than 1.0%, accordingly the upper limit of Si is defined as 1.0%.

Mn: not more than 1.0%

Mn has function to prevent embrittlement caused by S, however precipitation of η-phase ($Ni_3Ti$) is promoted and harmful to the ductility of the alloy when Mn is contained in the alloy more than 1.0%, accordingly the upper limit of Mn is defined as 1.0%.

Cr: more than 25% and not more than 32%

Cr is an inevitable element for improving the corrosion resistance of the alloy. It is necessary to contain Cr more than 25% in order to obtain the effect of this kind.

However, when Cr is excessively contained more than 32% in the alloy, brittle phases are precipitated during the use of the alloy as valves for the diesel engine, so that the upper limit of Cr is defined as 32%.

Ti: more than 2.0% and not more than 3.0%

Al: 1.0 to 2.0%

Ti and Al combine with Ni to form γ prime phase and have function to improve the high-temperature strength of the alloy. It is necessary to contain Ti more than 2.0% in the alloy in order to obtain the effect. Furthermore, it is necessary to contain Al not less than 1.0%.

However, if Ti and Al are contained more than 3.0% and 2.0% in the alloy respectively, embrittlement of the alloy is caused by excessive precipitation during the aging treatment and hot workability of the alloy is degraded, therefore the upper limits of Ti and Al are defined as 3.0% and 2.0% respectively in order to prevent these harmful influences.

Fe: not more than 3.0%

Fe is contained as impurities in the alloy according to this invention, it is possible to ensure Ni in a large quantity by controlling Fe not more than 3.0% as mentioned above. However, when the Fe content is controlled to an excessively low value, it becomes necessary to select raw materials of the alloy very severely and the increase in cost is brought, accordingly the upper limit of Fe is defined as 3.0% in this invention.

Co: not more than 2.0%

Co is an element to contribute to stability of austenite phase similar to Ni, but is controlled to not more than 2.0% in this invention in order to avoid the increase in cost of the alloy.

Co is the element mixed into the Ni-based alloy, it becomes necessary to severely select the raw material of the alloy and the cost is increased on the contrary in a case of controlling the Co content to remarkably low value, so that the Co content is allowed up to 2.0% in this invention.

B: not more than 0.02%

B is an element having function to improve the hot workability in addition to the creep strength of the alloy by segregation at grain boundaries. However, the hot workability of the alloy is injured if B is contained more than 0.02%, therefore the upper limit of B is defined as 0.02%.

Zr: not more than 0.15%

Zr has function to improve the creep strength of the alloy by segregation at the grain boundaries similar to B, however the creep strength is rather injured when Zr is contained more than 0.15%, accordingly the upper limit of Zr is defined as 0.15%. Partial cold working on the valve face or so Although the valve obtained by forging the high corrosion resisting alloy according to this invention may be used in the aging treated state after solid solution treatment according to a level of the required properties for the valve, partial cold working may be further applied to the valve at various working ratios according to demand, such as a type and a shape of valve or so. In this case, it is desirable to work the valve to the outer peripheral part of the vale face at a working ratio of 20 to 80% and to the center side on the valve face at a working ratio of 10 to 30%.

It is difficult to sufficiently enhance the strength of the valve at a part where high strength is required such as the valve face in a case of working the valve at a working ratio of lower than 10%, and conversely it is feared that cracks are produced in the valve if the valve is worked at a working ratio of higher than 80%.

In a case where it is necessary to perform the solid solution treatment in advance of the partial cold working, the solid solution treatment may be performed under a condition of:

| | |
|---|---|
| temperature | 1020° C.~1080° C. |
| time | 2 hrs~18 hrs, |

and the aging treatment may be performed successively under a condition of:

| | |
|---|---|
| temperature | 650° C.~800° C. |
| time | 5 hrs~16 hrs, |

EXAMPLE

Next, example of this invention will be explained below in detail.

Alloys having respective chemical compositions as shown in Table 1 were melted in a high frequency vacuum induction furnace, thereby obtaining ingots of 30 kg.

TABLE 1

| Alloy No. | | Chemical composition (we %) | | | | | | | | | | V attack | S attack | Hardness | Hardness after cold working |
|---|---|---|---|---|---|---|---|---|---|---|---|---|---|---|---|
| | | C | Si | Mn | Cr | Ti | Al | Fe | Co | B | Zn | | | | |
| Inventive example | No. 1 | 0.054 | 0.32 | 0.14 | 25.70 | 2.43 | 1.42 | 0.59 | 0.31 | — | — | 23.2 | 2.1 | 367 | 461 |
| | No. 2 | 0.035 | 0.12 | 0.71 | 27.31 | 2.16 | 1.04 | 0.02 | 0.15 | — | — | 24.5 | 2.5 | 361 | 473 |
| | No. 3 | 0.089 | 0.76 | 0.13 | 29.99 | 2.47 | 1.43 | 0.26 | — | 0.0040 | 0.064 | 21.5 | 3.2 | 383 | 478 |
| | No. 4 | 0.037 | 0.23 | 0.65 | 31.87 | 2.87 | 1.41 | — | 0.03 | 0.0035 | 0.062 | 23.8 | 1.2 | 377 | 481 |
| | No. 5 | 0.012 | 0.84 | 0.04 | 28.21 | 2.10 | 1.87 | 2.40 | 0.01 | 0.0140 | 0.064 | 25.7 | 3.3 | 378 | 466 |
| | No. 6 | 0.028 | 0.25 | 0.27 | 25.18 | 2.28 | 1.23 | 2.89 | 1.79 | 0.0037 | | 21.8 | 1.2 | 361 | 463 |

TABLE 1-continued

| Alloy No. | | Chemical composition (we %) C | Si | Mn | Cr | Ti | Al | Fe | Co | B | Zn | V attack | S attack | Hardness | Hardness after cold working |
|---|---|---|---|---|---|---|---|---|---|---|---|---|---|---|---|
| Conventional example | No. 7*1 | 0.064 | 0.24 | 0.38 | 19.54 | 2.51 | 1.47 | 1.50 | 0.04 | 0.0035 | 0.064 | 24.6 | 103.5 | 374 | 473 |
| | No. 8*2 | 0.052 | 0.14 | 0.13 | 18.97 | 3.12 | 1.45 | 0.32 | 12.08 | 0.0033 | — | 37.2 | 3.6 | 389 | 489 |
| | No. 9*3 | 0.032 | 0.14 | 0.13 | 30.53 | 1.45 | 0.93 | 0.32 | — | 0.0033 | — | 25.4 | 2.8 | 321 | 413 |

Notice
*1: Nimonic 80A (registered trademark of Inco Family of Company)
*2: Udimet 520 (registered trademark of Special Metals, Inc.)
*3: Nimonic 81 (registered trademark of Inco family of Company)

The respective ingots were forged into round bars of 85 mm in diameter and formed into valves through hot forging, subsequently the valves were subjected to solid solution treatment at 1020° C. for 2 hrs and then subjected to aging treatment at 750° C. for 16 hrs. By using specimens respectively cut out from the obtained valves, V(vanadium) attack test, S(sulfur) attack test and hardness test were performed.

After this , each of the valves 10 was treated with partial cold forging of 25% in reduction ratio on valve face 12 as shown in FIG. 1, and the hardness at the valve face 12 was measured respectively (the valve shape after the partial cold forging is shown with broken lines in FIG. 1). Obtained results are also shown in Table 1.

V attack test and S attack test were carried out under the following conditions. Further, the measurement of the hardness was performed through the Vickers hardness tester with load of 10 kg.

(S attack test)

By using a test piece machined in a size of 25×15×5 mm and mixed ashes of $Na_2SO_4$ (90%) and NaCl (10%) as corrosion ashes, the test piece was maintained in the mixed ashes at 800° C. for 20 hrs. Corrosion resistance against the S attack was evaluated by measuring corrosion loss after removing corrosion products attached on the surface of the test piece.

The aforementioned test was carried out after polishing the surface of the test piece with a emery paper of #500.

(V attack test)

Corrosion loss of the test piece was measured by removing corrosion products attached on the test piece after maintaining the test piece in mixed ashes of $V_2O_5$ (85%) and $Na_2SO_4$ (15%) at 800° C. for 20 hrs.

The test was performed by using the same test piece as that of S attack test after polishing the test piece surface with the emery paper of #500.

As is apparent from the results shown in Table 1, conventional alloy No. 7 which merely contains Cr of the order of 20% is inferior in the corrosion resistance, especially in the resistance against the S attack, conventional alloy No. 9 which contains Cr as much as 30% is excellent in the corrosion resistance but impossible to obtain the sufficient hardness after the aging treatment because of shortage of Ti and Al, and conventional alloy No. 8 which contains Co of 12% is excellent in both of the corrosion resistance and the hardness after the aging treatment but cost of the alloy becomes higher because Co is added in a large quantity.

In contrast with the above, the alloys according to this invention are excellent in the corrosion resistance and the hardness after aging treatment in all cases, and they are not expensive in the cost because Co is not contained so much. Furthermore, it is apparent that the hardness of the valves are improved effectively by performing cold working partially on the valves after being forged in near net shapes.

Although the explanation has been given concerning the preferred examples of this invention, they are merely examples of the present invention and it is possible to practice the invention in various forms without departing from the spirit and scope of this invention.

What is claimed is:

1. A high corrosion resisting alloy for a diesel engine valve consisting essentially by weight percentage of not more than 0.1% of C, not more than 1.0% of Si, an effective amount of Mn to prevent embrittlement caused by S to not more than 1.0% more than 25% and not more than 32% of Cr, more than 2.0% and not more than 3.0% of Ti, 1.0 to 2.0% of Al, and the balance being Ni plus incidental impurities.

2. A high corrosion resisting alloy for a diesel engine valve according to claim 1, wherein Fe and Co as said impurities are controlled to not more than 3.0% and 2.0%, respectively.

3. A high corrosion resisting alloy for a diesel engine valve according to claim 1, wherein said alloy further contains one or both of not more than 0.02% of B and not more than 0.15% of Zr.

4. A high corrosion resisting alloy for a diesel engine valve according to claim 2, wherein said alloy further contains one or both of not more than 0.02% of B and not more than 0.15% of Zr.

5. A diesel engine alloy valve consisting essentially by weight percentage of not more than 0.1% of C, not more than 1.0% of Si, an effective amount of Mn to prevent embrittlement caused by S to not more than 1.0% more than 25% and not more than 32% of Cr, more than 2.0% and not more than 3.0% of Ti, 1.0 to 2.0% of Al, and the balance being Ni plus incidental impurities.

6. A diesel engine alloy valve according to claim 5, wherein Fe and Co as said impurities are controlled to not more than 3.0% and 2.0%, respectively.

7. A diesel engine alloy valve according to claim 5, wherein said alloy valve further contains one or both of not more than 0.02% of B and not more than 0.15% of Zr.

8. A diesel engine alloy valve according to claim 5, wherein said alloy valve further contains one or both of not more than 0.02% of B and not more than 0.15% of Zr.

* * * * *